US005649689A

United States Patent [19]

Wilson

[11] Patent Number: 5,649,689

[45] Date of Patent: Jul. 22, 1997

[54] FENCE APPARATUS THAT IS FLEXIBLE AND DETACHABLE

[75] Inventor: Rodger Wilson, Howell, N.J.

[73] Assignee: Rodger E. Wilson, Howell, N.J.

[21] Appl. No.: 669,886

[22] Filed: Jun. 20, 1996

[51] Int. Cl.[6] ..... E04H 17/00; E04H 17/22

[52] U.S. Cl. ..... 256/24; 256/19; 256/66

[58] Field of Search ..... 256/DIG. 5, 65, 256/66, 19, 24

[56] References Cited

U.S. PATENT DOCUMENTS

| | | | |
|---|---|---|---|
| 639,884 | 12/1899 | Behrend | 256/22 X |
| 818,672 | 4/1906 | Eck et al. | 256/DIG. 5 |
| 2,094,519 | 9/1937 | Ballard | 256/21 X |
| 2,740,613 | 4/1956 | Berliner | 256/19 X |
| 3,254,464 | 6/1966 | Hoyt, Jr. | 256/19 X |
| 3,877,140 | 4/1975 | Topolsek | 256/19 X |
| 4,130,272 | 12/1978 | Emmie | 256/22 |
| 5,421,556 | 6/1995 | Dodge et al. | 256/19 X |
| 5,529,289 | 6/1996 | Lancer, Sr. | 256/19 X |

*Primary Examiner*—Anthony Knight
*Attorney, Agent, or Firm*—Rodger E. Wilson

[57] ABSTRACT

The present invention describes a fence that is durable, rust-free, maintenance-free, flexible and easy to assemble and unassemble. The fence comprises a fence panel for providing a barrier, posts for vertically supporting the fence panel, and post hole inserts for securing the fence to a ground. The fence panel is preferably constructed of a plastic material such that flexibility is promoted, and has connector means for securing the fence panel to the posts. The posts have receptacle means for receiving and interlocking with the connector means of the fence panel. Preferably, the connector means and receptacle means provide a mechanism for detachably securing the fence panel to the posts. The post hole inserts are inserted into the ground, and includes a cavity adapted to receive and interlock with the posts.

7 Claims, 5 Drawing Sheets

FENCE APPARATUS THAT IS FLEXIBLE AND DETACHABLE

FIELD OF THE INVENTION

The present invention generally relates to the field of fences and, more particularly to fences constructed of plastic.

BACKGROUND OF THE INVENTION

Fences have been used for several hundred years as means for enclosing or providing a barrier for real property. Typical prior art fences are constructed of wood or metal, and comprises fence panels and posts which are permanently secured or driven into a ground. However, fences constructed of wood are subject to swelling and shrinking due to moisture and temperature changes. Likewise, fences constructed of metal are subject to rust and corrosion due to moisture.

Large amounts of time and labor are typically required to assemble these prior art fences. First, the posts must be driven into the ground or secured to the ground using concrete footings. Second, the fence panels must be mounted to the posts. The manner in which the fence panels are mounted varies according to the type of fence panels or connection devices being used, and the design or purpose of the fence. Typical fence panels comprise vertically oriented fence modules, such as wooden boards, mounted to one or more horizontal rails. The horizontal rails are used to mount the fence panels to the posts and provide lateral support for the fence panels. However, the typical horizontal rails are rigid, thereby adding an inflexible quality to the fence panel. Note that once the prior art fence is assembled, unassembling the fence or moving the fence to another location becomes a difficult task, particularly when the posts are secured to the ground using the concrete footings.

Fences designed to prevent persons outside of the fenced property from seeing inside the fence property often require larger amounts of time and labor to assemble. These fences, referred to herein as privacy fences, require the fence modules to be positioned directly adjacent to each other such that there are no spaces between the fence modules. Accordingly, a greater quantity of fence modules are used and more time and labor are needed in order to assemble the privacy fences. Furthermore, the privacy established by the privacy fences are often compromised when wood is used to construct the privacy fences. The reason for this is because of the swelling and shrinking of the fence modules caused by moisture and temperature changes would result in the creation of spaces between adjacent fence modules.

Accordingly, there exists a need for a fence that is not subject to swelling or shrinking due to changes in weather and temperature. There also exists a need for a fence that is simpler to assemble, and simpler to unassemble such that the fence may be moved.

SUMMARY OF THE INVENTION

The present invention discloses a fence apparatus constructed of a plastic material that is flexible and detachable. The present invention fence apparatus comprises a fence panel, a post and a post hole insert. The fence panel provides a barrier, and includes fence modules and connector means for detachably securing the fence panel to the post. The fence modules preferably have bevels to promote the flexibility of the fence apparatus.

The post is a mechanism for vertically supporting the fence panel. The post has receptacle means for receiving and interlocking with the connector means of the fence panel such that the fence panel can be secured to the post. The post is secured to a ground using the post hole insert. The post hole insert comprises a body with a cavity which is inserted into the ground. The cavity is adapted to receive and interlock with the post, thereby providing a detachable mechanism by which the post can be secured to the ground.

In one embodiment of the present invention, the connector means are cylindrical or spherical elements with a diameter d, and the receptacle means are curved grooves with a diameter greater than d. The curved grooves and connection means are configured such that the fence panel cannot be displaced laterally from the post when the cylindrical or spherical elements are positioned within the curved grooves.

In another embodiment of the present invention, the body includes flighting screws and a pointed tip for fastening the post hole insert into the ground and facilitating the insertion of the post hole insert, respectively. Advantageously, the post hole insert is not permanently secured to the ground, thereby making it easier to unsecure and re-secure the post hole insert and fence in another location.

BRIEF DESCRIPTION OF THE DRAWINGS

For a better understanding of the present invention, reference may be had to the following description of exemplary embodiments thereof, considered in conjunction with the accompanying drawings, in which.

DETAILED DESCRIPTION

Figure 1:
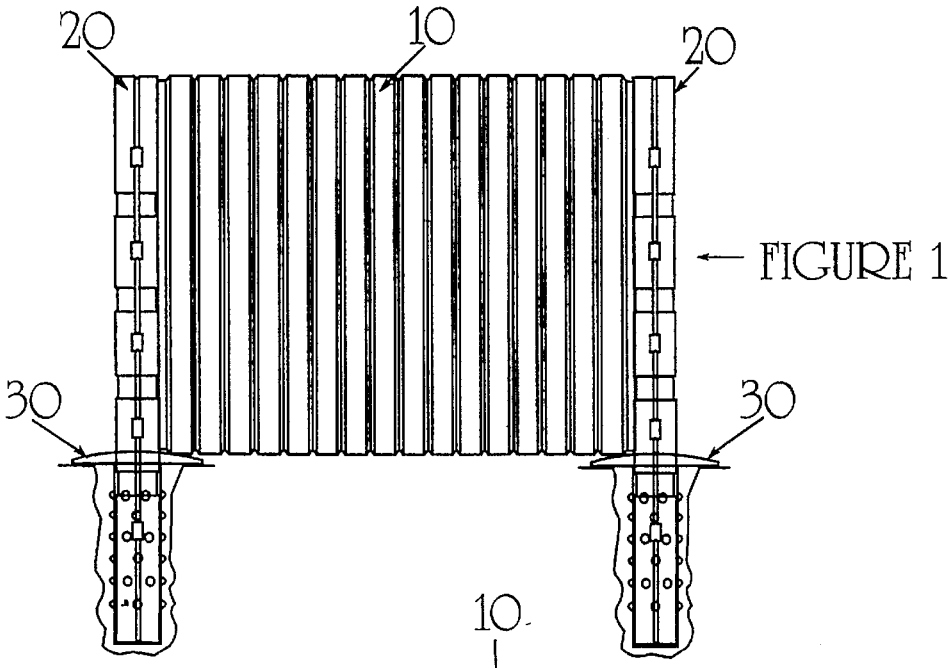
FIG. 1 depicts a front view of a fence section in accordance with one embodiment of the present invention.

The present invention is a fence apparatus that is flexible and easily detachable. Referring to FIG. 1, there is illustrated a front view of a fence section 02 in accordance with one embodiment of the present invention. As shown in FIG. 1, the fence section 02 comprises a fence panel 10, posts 20 and post hole inserts 30.

Figure 2:
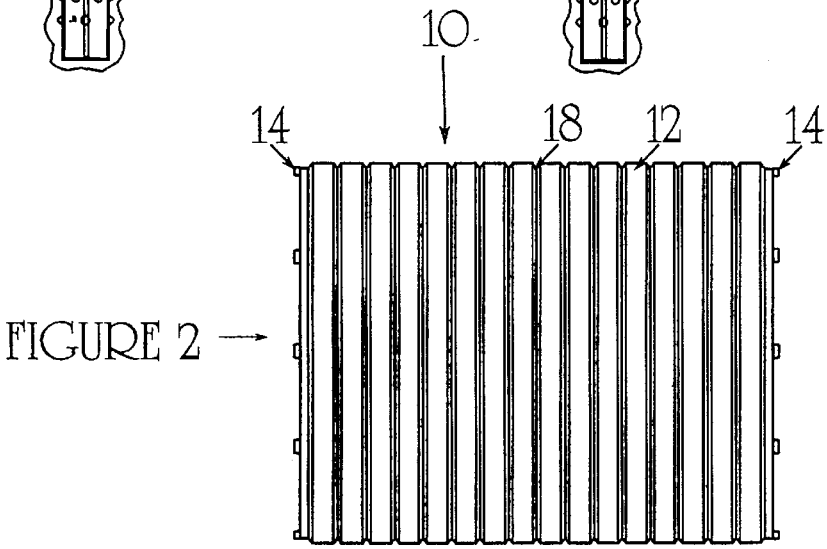
FIG. 2 depicts a front view of a fence panel in accordance with the embodiment of the present invention illustrated in FIG. 1.
Figure 3:
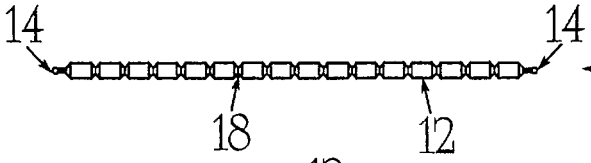
FIG. 3 depicts a top view of the fence panel of FIG. 2.
Figure 3A:
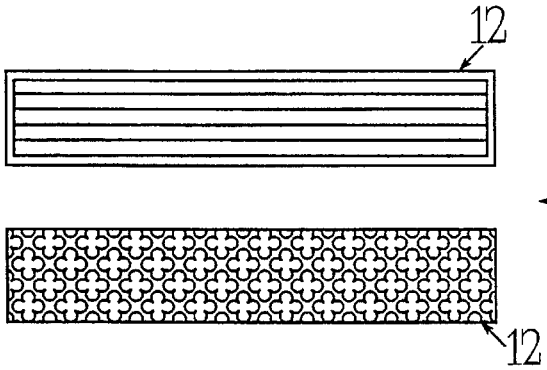
FIG. 3*a* depicts a front view of a fence panel with a gothic exterior surface and a fence panel with a louver exterior surface.

The fence panel 10 provides a barrier between the separate posts 20. Referring to FIGS. 2 and 3, there are illustrated a front view and a top view of the fence panel 10, respectively, in accordance with one embodiment of the present invention. As shown in FIG. 2, the fence panel 10 comprises fence modules 12 and connector means 14. The fence modules 12 have an ornamental exterior surface for providing the fence panel 10 with an aesthetic quality. In a preferred embodiment of the present invention, the ornamental exterior surface simulates a series of vertically oriented wooden boards, thereby forming a privacy fence, as the term is well-known in the art. In alternate embodiments of the present invention, the ornamental exterior surface have a gothic or louver design, as shown in FIG. 3*a*.

Figure 4:
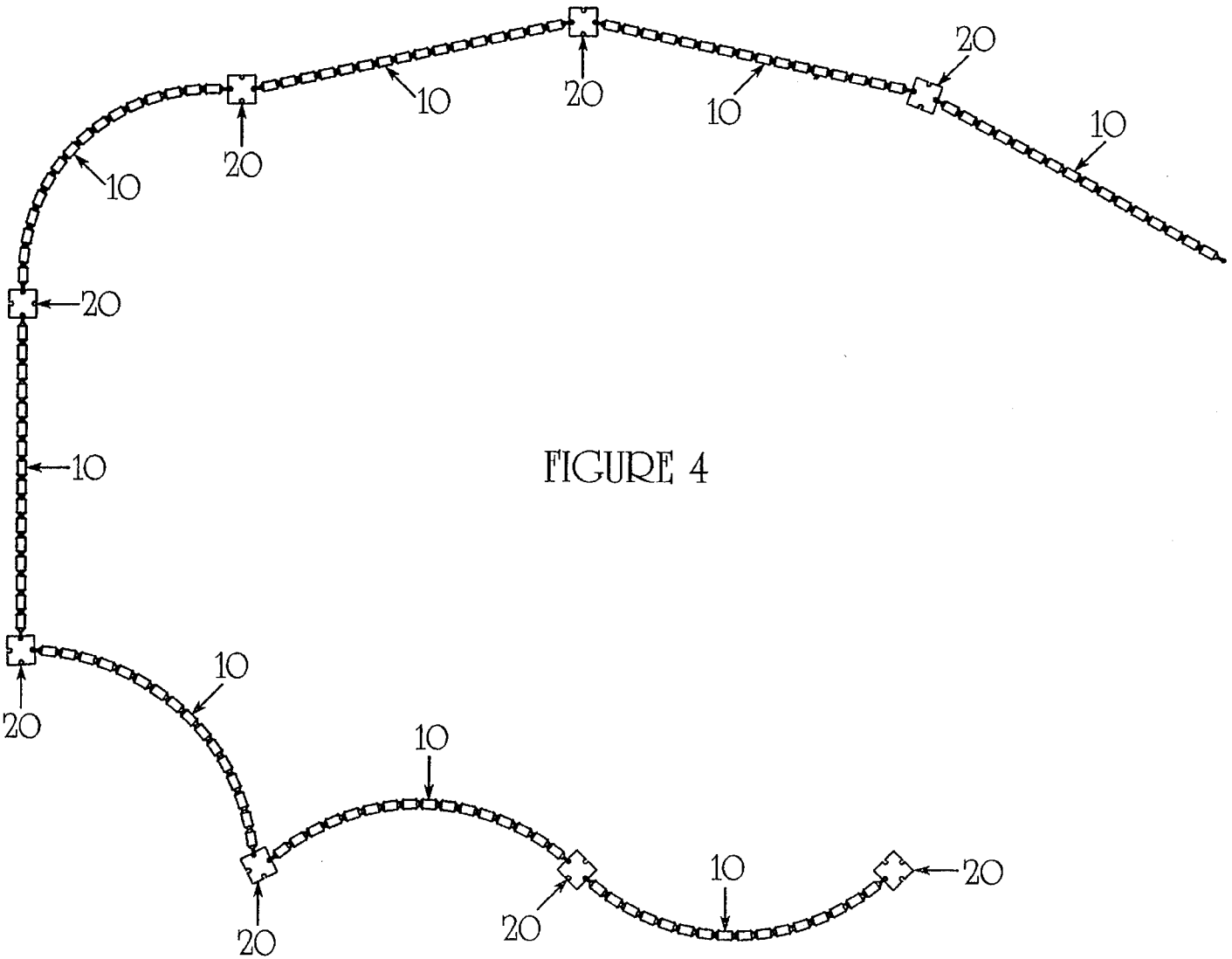
FIG. 4 depicts a top view of a series of the fence panels illustrating its flexibility in accordance with one embodiment of the present invention.

The fence panel 10 is constructed of a durable, rigid material, such as wood or metal. Note that fence panel 10 and the post 20 need not be constructed of a material having substantial structural strength because they do not support other structures, such as a roof. In a preferred embodiment of the present invention, the fence panel 10 is constructed of a plastic material, such as recycled plastic. Note that using recycled plastic to construct the present invention also further an environmental goal, i.e., re-using plastic. The plastic construction offers several advantages. First, plastic fence panels 10 are durable, rust-free and maintenance-free. Unlike wooden fence panels, the plastic fence panels are not subject to swelling or shrinking due to moisture and temperature changes. Unlike metal fence panels, the plastic fence panels are not subject to rust or corrosion due to moisture. Second, the plastic fence panels are more flexible than the wooden or metal fence panels. Accordingly, the plastic fence panels can be configured to serve an aesthetic goal or conform to a boundary of real property. Referring to FIG. 4, there is illustrated a top view of a series of plastic fence panels 10. As shown in FIG. 4, the plastic fence panels 10 can be configured to bend around a corner, or to have a scalloped, wavy or zig-zag appearance.

In a preferred embodiment of the present invention, the fence modules 12 include bevels 18 for promoting the flexibility of the plastic fence panel 10, as shown back in FIGS. 2 and 3. The bevels 18 are preferably forty-five degrees because an angle of ninety degrees can therefore be attained between any two fence modules 12 in the fence panel 10.

Figure 4A:
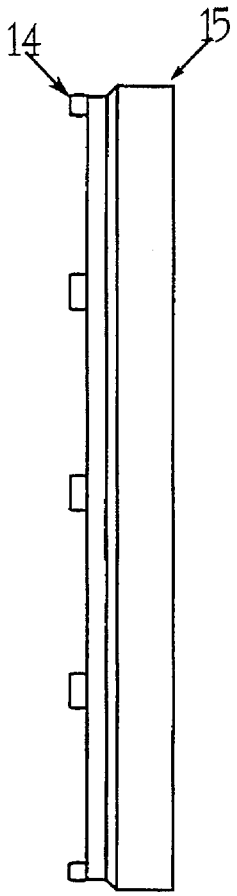
FIG. 4*a* depicts a front view of an exemplary example of a fence module attachment element.
Figure 4B:
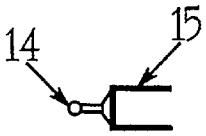
FIG. 4*b* depicts a top view of the fence module attachment element illustrated in FIG. 4*a;*

The fence panel 10 is secured to the posts 20 via the connector means 14, which are mounted to the first and last fence modules 12 of the fence panel 10. In an alternate embodiment of the present invention, the connector means 14 are mounted to a fence module attachment element which is operable to connect the connector means 14 to an end fence module 12. Referring to FIGS. 4*a* and 4*b*, there are illustrated a front view and a top view, respectively, of an exemplary example of a fence module attachment element 15 adapted to fit over an end fence module 12 that simulates a vertically oriented wooden board. As shown in FIGS. 4*a* and 4*b*, the fence module attachment element 15 is a sleeve adapted to fit over the end fence module 12 and secure the connector means 14 to the fence panel 10 such that the fence panel 10 can be secured to the posts 20.

Figure 5:
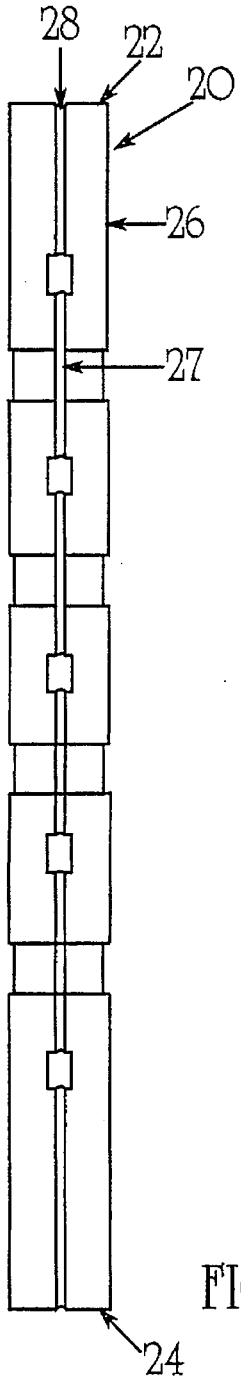
FIG. 5 depicts a front view of a post adapted to receive connector means in accordance with the embodiment of the present invention illustrated in FIG. 1.
Figure 6:
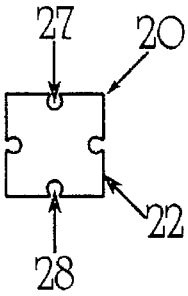
FIG. 6 depicts a top view of the post illustrated in FIG. 5.

The posts 20 are used to anchor the fence section 02 to a ground and vertically support the fence panel 10. Referring to FIGS. 5 and 6, there are illustrated a front view and a top view of a post 20, respectively, adapted to receive the connector means 14. As shown in FIGS. 5 and 6, the post 20 is preferably a beam with a square traverse cross-section. The post 20 has a top 22, a bottom 24, sides 26 and receptacle means 28 for receiving and interlocking with the connector means 14. In a preferred embodiment of the present invention, the receptacle means 28 are grooves 28 in the sides 26 running the length of the post 20. The grooves 28 are adapted to receive and hold the connector means 14 of the fence panel 10. The fence panel 10 is secured to the posts 20 by sliding the connector means 14 into the grooves 28 through the top 22 or the bottom 24 of the posts 20.

As shown in FIGS. 2, 3, 5 and 6, the connector means 14 are preferably cylindrical elements 14 with a diameter $d_1$ mounted vertically to end fence modules 12, and the grooves 28 are preferably curved grooves 28 with first groove openings 27. The curved grooves 28 have a diameter $d_2$ which is slightly greater than $d_1$ such that the cylindrical elements 14 can fit within the curved grooves 28. The cylindrical elements 14 and curved grooves 28 are preferably configured such that the cylindrical elements 14 cannot be laterally displaced through the openings 27 when positioned within the curved grooves 28—that is, the first groove openings 27 are smaller than the diameter $d_1$ of the cylindrical elements 14. In other words, the cylindrical elements 14 can only be disengaged from the grooves 28 by sliding the cylindrical elements 14 through the top 22 or the bottom 24 of the posts 20.

Figure 7:
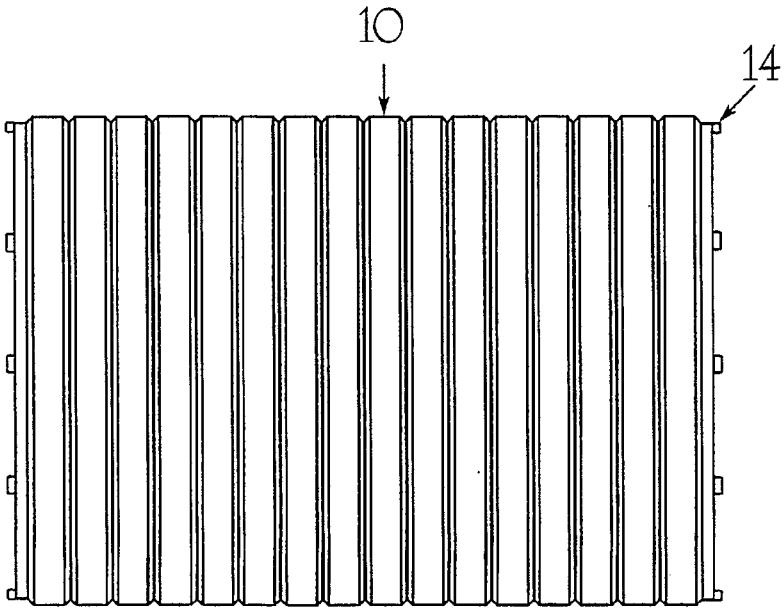
FIG. 7 depicts a front view of a fence panel and a post in accordance with an alternate embodiment of the present invention.

Referring to FIG. 7, there are illustrated a front view of a fence panel 10 and a post 20 in accordance with an alternate embodiment of the present invention. As shown in FIG. 7, the fence panel 10 has a series of cylindrical or spherical elements 14 with a diameter $d_1$ for attaching the fence panel 10 to the post 20, and the post 20 has curved grooves 28 with a diameter $d_2$, first groove openings 27 and second groove openings 29. The first groove openings 27 and the second groove openings 29 are smaller and larger, respectively, than the diameter of the cylindrical or spherical elements 14. Thus, the cylindrical or spherical elements 14 can pass through the second groove openings 29 but not through the first groove openings 27. The fence panel 10 is secured to the post 20 by positioning the cylindrical or spherical elements 14 into the curved grooves 28 through the second groove openings 29, and then sliding the balls 14 along the curved grooves 28 away from the second groove openings 29 such that the cylindrical or spherical elements 14 are positioned under the first groove openings 27 and slidably locked within the curved grooves 28. Note that each of the cylindrical or spherical elements 14 is preferably spaced a distance D from its neighboring cylindrical or spherical elements 14. Likewise, each of the second groove openings 29 are preferably spaced a distance D from its neighboring second groove openings 29 such that each of the cylindrical or spherical elements 14 can simultaneously pass through the second groove openings 29 when being inserted into the groove 28.

Several advantages are offered by the present invention configuration of posts 20 and the fence panel 10. First, no tools are required to secure or unsecure the fence panel 10 to or from the posts 20. Second, the cylindrical or spherical elements 14 and the curved grooves 28 allow the fence panel 10 to be secured to the post 20 at a variety of angles, thereby permitting a variety of design options. Third, the fence panel 10 can be raised off the ground without unsecuring the fence panel 10 from the post 20 to allow grass growing under the fence panel 10 to be mowed or to make it easier to move large objects onto the fenced property.

Figure 8:
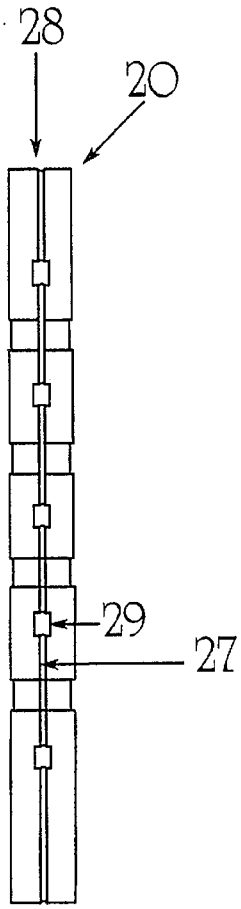
FIG. 8 depicts a front view of a post hole insert in accordance with the embodiment of the present invention illustrated in FIG. 1.
Figure 8:
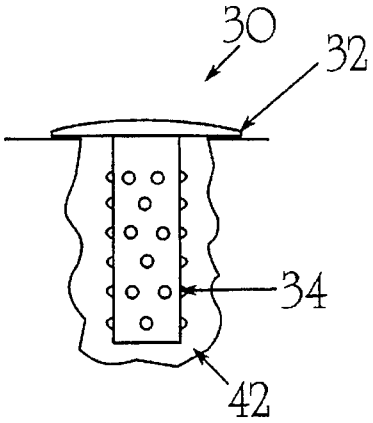
Figure 9:
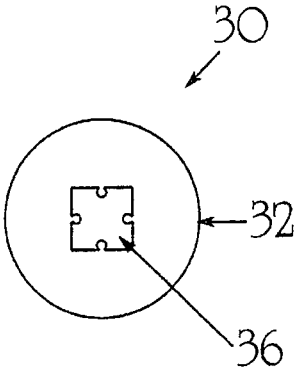
FIG. 9 depicts a top view of the post hole insert illustrated in FIG. 8.

The fence section 02 of the present invention is secured to the ground using the post hole inserts 30. Unlike prior art fences, the posts 20 are not driven into the ground or anchored in concrete footings in order to secure the fence section 02 to the ground. The post hole inserts 30 are novel mechanisms for detachably securing the posts 20 to the ground. Referring to FIGS. 8 and 9, there are illustrated a front view and a top view, respectively, of one embodiment of the post hole insert 30. As shown in FIG. 8, the post hole insert 30 comprises a lip 32 and a body 34. The post hole insert 30 is inserted into the ground in a manner such that the lip 32 and the body 34 are positioned above and below the ground, respectively. The body 34 has a length l that, when inserted into the ground, the post hole insert 30 is operable to vertically and laterally support the fence section 20—that is, the weight of the fence panel 10 and the posts 20 will not cause the post hole inserts 30 to shift. The body 34 further includes a cavity 36 adapted for receiving the post 20. As shown in FIG. 9, the cavity 36 is shaped complementary to the post 20 such that the post hole insert 30 can interconnect with the post 20. Advantageously, the post 20 can be secured to and unsecured from the post hole inserts 30 and the ground, without tools, by merely inserting or removing the post 20 from the post hole insert 30.

Figure 10:
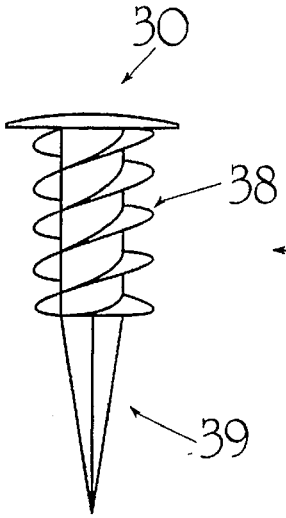
FIG. 10 depicts a front view of an exemplary example of a detachable post hole insert in accordance with an alternate embodiment of the present invention.

As shown back in FIG. 8, the post hole insert 30 can be secured to the ground using a concrete footing 42 or other type of hardening substance. In another embodiment of the present invention, the post hole insert 30 has fastening means for detachably securing the post hole insert 30 to the ground. Referring to FIG. 10, there is illustrated an exemplary example of a detachable post hole insert 31. As shown in FIG. 10, the body 34 further comprises an exterior flighting screw 38 and a pointed tip 39 for fastening and facilitating the insertion of the post hole insert 30 into the ground. In this embodiment, the post hole insert 30 can also be easily removed from the ground since a concrete footing is not used, thereby permitting the fence section 02 to be repositioned without undue time and labor. In another embodiment of the present invention, not shown, the body 34 includes a pointed tip but no exterior flighting screw. In this embodiment, the post hole insert 30 can be easily driven into the ground.

Although the dimensions of the fence panel 10, the post 20 and the post hole insert 30 can be of any desired sizes, conventional length by height by width dimensions are as follows. The fence panel 10 has eight feet by six feet by one inch dimensions, and includes cylindrical or spherical elements 14 with a diameter of one inch. The post 20 has four inches by nine feet by four inches dimensions, and includes curved grooves 28 with a diameter slightly greater than one inch. The body 34 has a cavity with width and length dimensions slightly greater than three inches, and a depth or height of approximately one foot.

Figure 11:
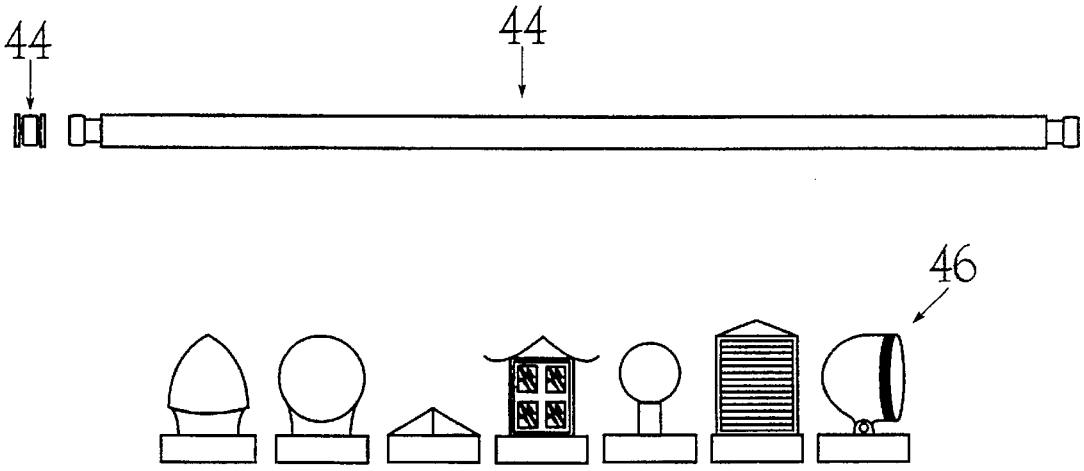
FIG. 11 depicts a front view of an exemplary example of a rail and a variety of post caps in accordance with an alternate embodiment of the present invention.

In alternate embodiments of the present invention, the fence section 02 further comprises a rail for adding lateral support to the fence panel 10, and a post cap for locking the connector means 14 within the grooves 28. Referring to FIG. 11, there are illustrated an exemplary example of a rail 44 and a variety of post caps 46. As shown in FIG. 11, the rail 44 has a flange adapted to fit over the top edges of the fence modules 12 and provide lateral support to the fence panel 10, and the post caps 46 are lids adapted to fit over the top 22 of the posts 20 thereby preventing the fence panel 10 from inadvertently sliding upward and protecting the grooves 28 from dirt and moisture. The post caps 46 may also have an aesthetic design, such as gothic and louver, or be operable to provide illumination.

The above description is an exemplary mode of carrying out the present invention. References to specific examples and embodiments in the description should not be construed to limit the present invention in any manner, and is merely provided for the purpose of describing the general principles of the present invention. It will be apparent to one of ordinary skill in the art that the present invention may be practiced through other embodiments.

I claim:

1. A fence comprising:

at least two vertically extending posts, each post having at least one first groove extending the vertical length of the post with a plurality of second grooves extending along the first groove in spaced apart fashion, the first groove being smaller in width than the second grooves and in communication therewith;

at least one panel composed of a single continuous piece of plastic material, a plurality of vertically extending bevels on both sides of the panel to create reduced thickness areas that provide flexibility to the panel so that the panel can be bent at the reduced thickness areas to conform to the shape of the area to be enclosed, a plurality of male connectors attached to the panel at each end with the male connectors extending outwardly, the male connectors corresponding in number and position to the number and position of the second grooves;

wherein the panel is attached to the posts by inserting the male connectors into the second grooves and sliding the panel downwardly so that the male connectors are out of alignment with the second grooves.

2. The fence as recited in claim 1 wherein the post is attached to the ground by a post hole insert that is separably attached to the post, the post hole insert including a flighting screw attached to the exterior of the post hole insert and a lip for controlling the depth of insertion of the post hole insert.

3. The fence as recited in claim 1 wherein the post is attached to the ground by a post hole insert that is anchored to the ground by concrete.

4. The fence as recited in claim 1 wherein each post include a cap for protecting and decorating the post.

5. The fence as recited in claim 1 further comprising two attachment elements, each attachment element being fixedly attached to a respective end of the panel and wherein the male connectors are part of the attachment elements.

6. The fence as recited in claim 1 wherein the male connectors are integral and contiguous with the panel.

7. The fence as recited in claim 1 wherein a horizontal rail extends between the posts to provide lateral support to the panel.

* * * * *